United States Patent [19]

Boublil

[11] Patent Number: 4,905,327

[45] Date of Patent: Mar. 6, 1990

[54] AUTOMATIC SEAT FOR GIVING HANDICAPPED PERSONS ACCESS TO THE WATER IN A BATH-TUB

[75] Inventor: David Boublil, 9, rue de Brement, F 93130 Noisy-Le-Sec, France

[73] Assignee: David Boublil, Noisy-le-Sec, France

[21] Appl. No.: 187,060

[22] PCT Filed: Jul. 28, 1987

[86] PCT No.: PCT/FR87/00297

§ 371 Date: Apr. 1, 1988

§ 102(e) Date: Apr. 1, 1988

[87] PCT Pub. No.: WO88/00821

PCT Pub. Date: Feb. 11, 1988

[30] Foreign Application Priority Data

Aug. 1, 1986 [FR] France ..... 86 11171

[51] Int. Cl.[4] ..... A47K 3/12; A61G 7/10

[52] U.S. Cl. ..... 4/562; 4/564; 5/81 R; 5/83; 414/541; 414/921

[58] Field of Search ..... 4/555, 559–566; 5/81 R, 81 B, 83; 414/541, 543, 921, 542; 248/404, 416; 272/28 R, 28 S, 29; 187/1 R, 9 R, 17; 212/134, 223, 253

[56] References Cited

U.S. PATENT DOCUMENTS 3,291,261 12/1966 Robb ..... 414/541 X
3,413,662 12/1968 Stayton ..... 4/562
4,400,032 8/1983 de Polo ..... 297/349
4,733,418 3/1988 Luther ..... 4/562

FOREIGN PATENT DOCUMENTS 2101514 7/1972 Fed. Rep. of Germany ..... 212/253
2580563 10/1986 France ..... 414/542

*Primary Examiner*—Henry J. Recla
*Assistant Examiner*—R. M. Fetsuga
*Attorney, Agent, or Firm*—Mason, Fenwick & Lawrence

[57] ABSTRACT

A device for enabling persons with reduced mobility to enter and leave a bath tub comprises an upper collar, a lower collar, a vertical column secured to the ceiling by the upper collar and to the floor by the lower collar, a jack for holding the column under compression for making the column completely rigid, and a support assembly mounted on the column for pivotal and vertical sliding motion. The support assembly comprises a member having first and second ends and a bend therein, a guide tube secured in the bend and having a side surface, first and second guide rings disposed in the first and second ends, respectively, of the member, a water-activated jack in fluid communication with the water tap of the bath tub and secured to a side surface of the guide tube, a roller mounted on the jack and resting on a track in the lower collar, and a seat supported on a seat supporting arm mounted in a bracket secured to the back of the support assembly. The distance of the seat from the vertical column and the support assembly can be adjusted by a bracket. The seat is provided with an extension pivotably mounted thereto for holding the bather's legs in a horizontal position.

5 Claims, 3 Drawing Sheets

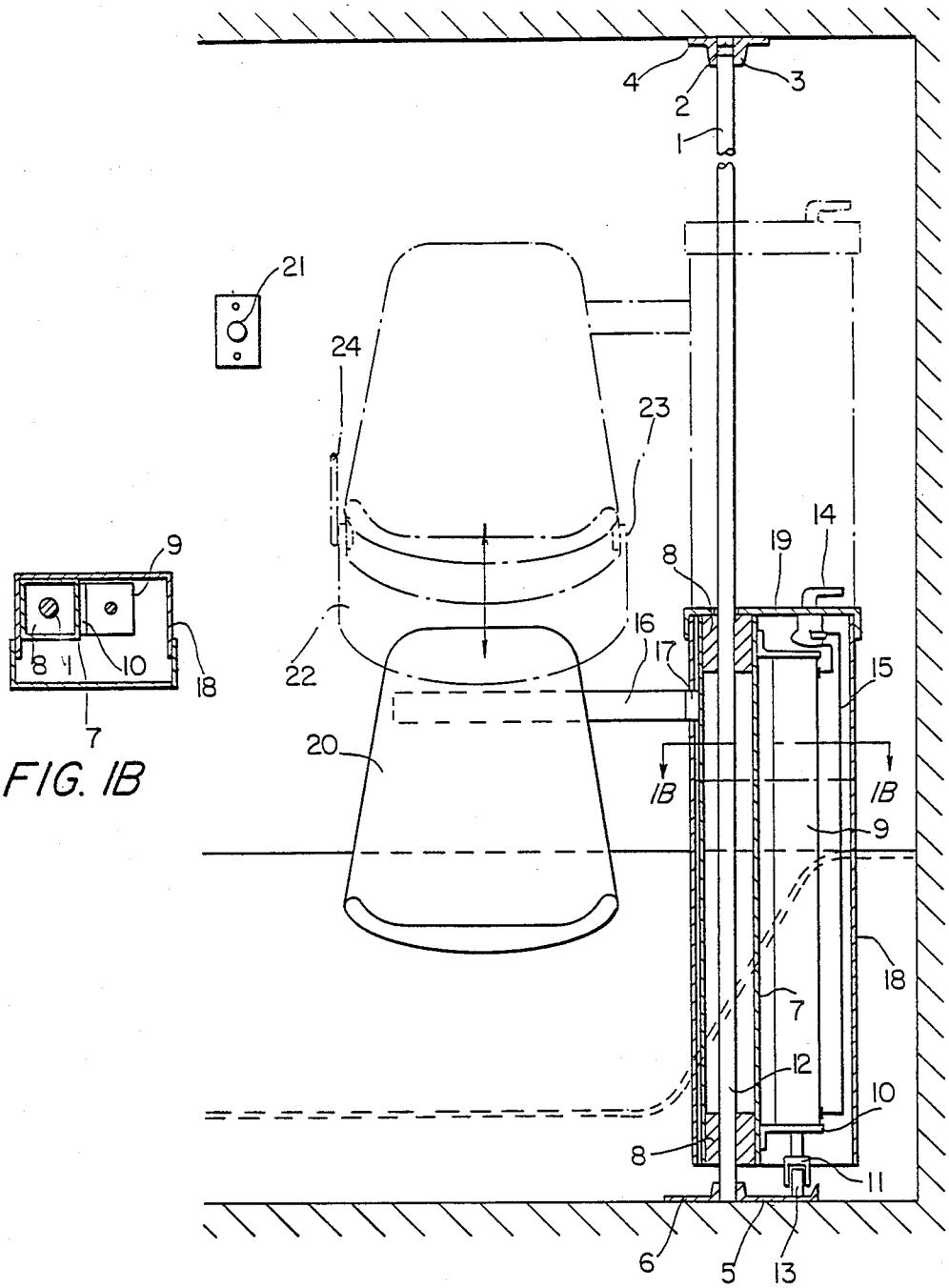
FIG. IB
FIG. IA

AUTOMATIC SEAT FOR GIVING HANDICAPPED PERSONS ACCESS TO THE WATER IN A BATH-TUB

BACKGROUND OF THE INVENTION

The invention relates to means and equipment for giving handicapped persons or persons with reduced mobility or elderly persons access to water in a bathtub with complete independence and without effort.

SUMMARY OF THE INVENTION

The devices according to the invention have the following purpose:

(a) to enable a handicapped person or a person with reduced mobility or an elderly person to enter or leave his bath-tub without effort and completely independently, (b) to be extremely simple, economic and to operate on tap water, and (c) not to require any maintenance.

The foregoing objects are achieved by provision of a device for enabling persons with reduced mobility to enter and leave a bath tub, comprising an upper collar, a lower collar, a vertical column secured to the ceiling by the upper collar and to the floor by the lower collar, a jack for holding the column under compression for making the column completely rigid, and a support assembly mounted on the column for pivotal and vertical sliding motion. The support assembly comprises a member having first and second ends and a bend therein, a guide tube secured in the bend and having a side surface, first and second guide rings disposed in the first and second ends, respectively, of the member, a water-activated jack in fluid communication with the water tap of the bath tub and secured to a side surface of the guide tube, a roller mounted on the jack and resting on a track in the lower collar, and a seat supported on a seat supporting arm mounted in a bracket secured to the back of the support assembly.

In one aspect of the invention, the distance of the seat from the vertical column and the support assembly can be adjusted by a bracket.

In another aspect of the invention, the seat is provided with an extension pivotably mounted thereto for holding the bather's legs in a horizontal position.

A better understanding of the disclosed embodiments of the invention will be achieved when the accompanying detailed description is considered in conjunction with the appended drawings, in which like reference numerals are used for the same parts as illustrated in the different figures.

BRIEF DESCRIPTION OF THE DRAWINGS

FIG. 1A is a front elevational view with parts broken away of a device according to the invention for enabling persons with reduced mobility to enter and leave a bath tub, the raised position of the device being shown in dotted lines;

FIG. 1B is a cross-sectional view of the device shown in FIG. 1A, taken along line A—A;

DESCRIPTION OF THE PREFERRED EMBODIMENT

The device according to the invention is made up of simple dismountable components as shown in the accompanying drawings.

Figure 2A:
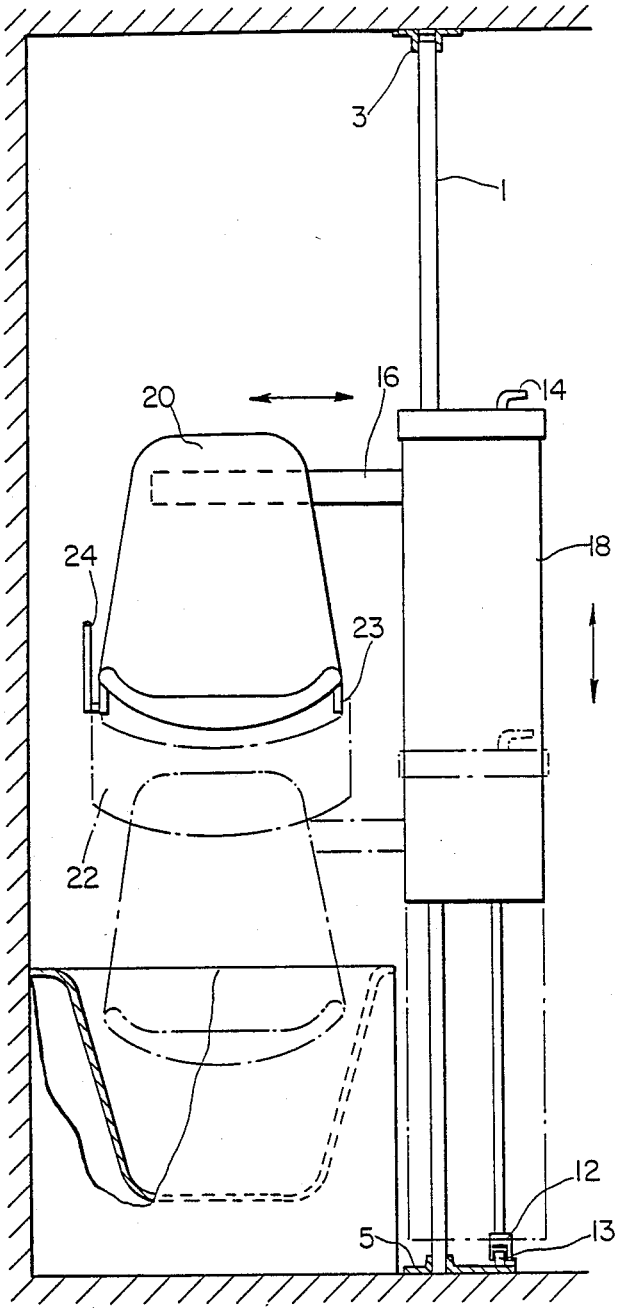
FIG. 2A is a front elevational view of the device shown in FIG. 1A, with the lower position of the device shown in dotted lines.
Figure 2B:
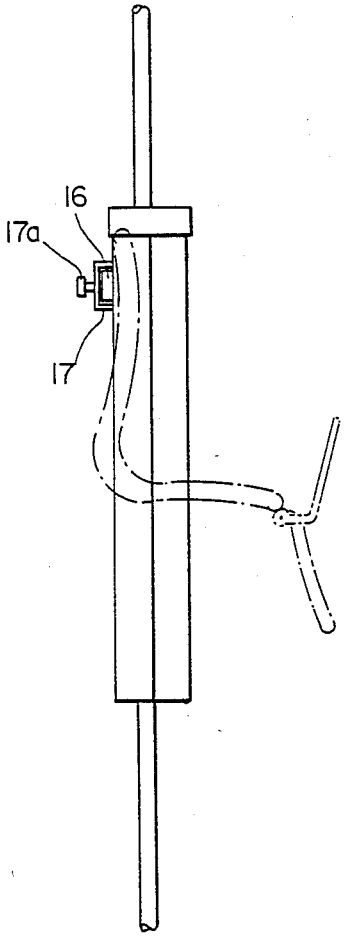
FIG. 2B is a side elevational view of the support assembly of the device.

It is made up of two principal parts, a guide and support column (1) and a support assembly (7). The guide and support column (1) is made of steel treated against corrosion or stainless steel, e.g. 45 mm in diameter, column (1) rests on the ground at one end and is held compressed by a screw jack (2) and pinned to a collar (3) secured (4) to the ceiling at the other end, thus giving a completely stable column. The bottom part is secured by a second collar (5) fixed to the ground (6), which also serves as a track for a roller (13). When thus secured, the column is extremely rigid. It can be either in one piece or telescopic. To facilitate rotation of the support assembly (7), the column is secured e.g. 10 cm from the edge of the bath, and 20 cm from the wall perpendicular to the edge of the bath tub, as shown in FIG. 2A. The support assembly (7) comprises a square or cylindrical tube welded in a "U" or "C" section member where plastic guide rings (8) are secured to the ends. Alternatively they can be replaced by ball sleeves or the like, to obtain good guidance. A jack (9) equipped with brackets (10) and securing means (11) is mounted in the support assembly, which is e.g. 80 cm high. The nose of the jack, which extends downwards, is equipped with a female yoke (12) in which a roller (13) is mounted. When thus mounted, the assembly is monobloc. By action of the jack, the support assembly (7) slides along the column upwards or downwards. By means of the roller (13), the support assembly can pivot very easily around the column (1). A bracket (17) is secured e.g. to the rear surface and serves as a recess for a supporting arm (16) for receiving a seat (20), which can alternatively be e.g. a flap seat, so as to occupy minimum space in the bathroom. The bracket (17) includes a locking screw (17*a*) for adjusting the distance of the seat (20) from the side surface of the device. When all the components are assembled, a casing (18) covers them all. The top part of the casing can be closed by a cover (19). A control handle (14) can be mounted at the front or on the cover and the supply pipes (15). The control means can be a 4-way cock supplying water to the two jack orifices. Operation is very simple. The person sits in the seat 20 in the rest position as shown in FIG. 1A, and then turns the control handle (14) to the "up" position and the seat rises e.g. 600 mm, i.e. the stroke of the jack, so that the person's feet do not touch the edge of the bath tub.

Figure 3:
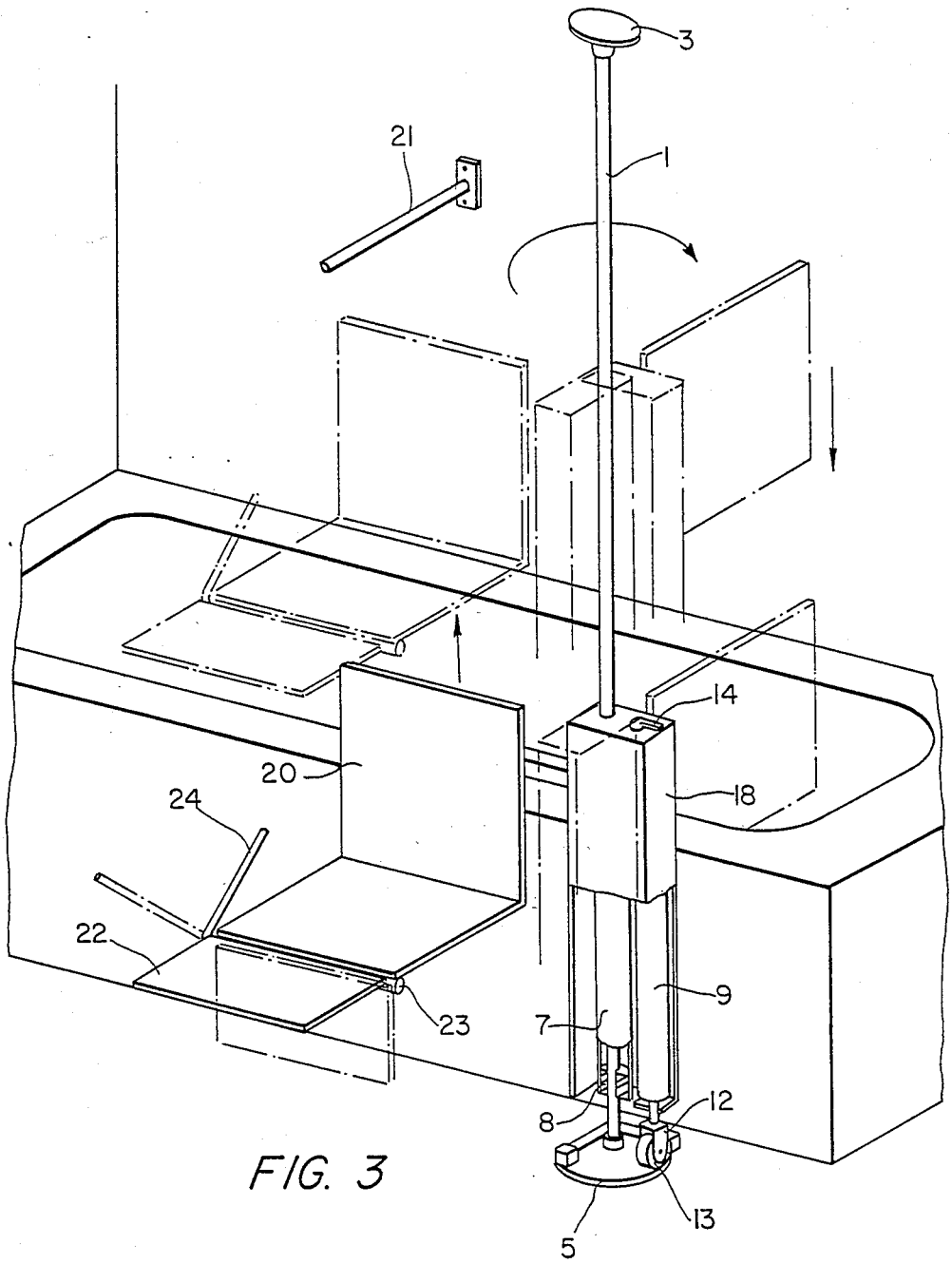
FIG. 3 is a perspective view of the device of FIG. 1A, with alternate positions of the seat shown in dotted lines.

In the top position, the person pivots the seat through 90° by pressing on a bar (21) secured to the wall, and then moves the control handle to the "down" position and the seat goes down a distance equal to the stroke of the jack, i.e. 600 mm for example. In the bottom position, therefore, the seat is about 6 or 7 cm from the bottom of the bath tub. The handicapped person is in the bath with minimum effort and without any assistance. In order to leave the bath, the person returns to the seat and performs the reverse operation, i.e. he rises by the distance equal to the jack stroke and pivots through 90°, his back to the bath tub. He then turns the control handle to the "down" position and returns to the initial position. The seat can be equipped with an extension (22) for holding the bather's legs in a horizontal position, the extension pivoting around a joint (23) secured under the seat (20) and actuated by a lever (24) which can be locked in the rest or horizontal position as shown in FIG. 3.

What is claimed:

1. A device for enabling persons with reduced mobility to enter and leave a bath tub in a room having a ceiling and a floor, comprising:

an upper collar;

a lower collar having a track;

a vertical column having a top and a bottom, said top of said column adapted to be secured to the ceiling by said upper collar and said bottom of said column adapted to be secured to the floor by said lower collar;

jack means for holding said column under compression for making said column completely rigid;

a support assembly mounted on said column for pivoting and vertical sliding motion, said support assembly having a back and comprising a member having first and second ends and a bend therein, a guide tube secured in said bend and having a side surface, first and second guide rings disposed in said first and second ends, respectively, of said member, a water-activated jack in fluid communication with the water tap of the bath tub and secured to said side surface of said tube, said jack having a downwardly oriented nose equipped with a female yoke, first bracket means for securing said jack to said side surface of said tube, a tight-sealing roller mounted on said female yoke of said jack and resting on said track of said lower collar, a seat supporting arm having a distal end and a proximal end, a seat supported at said distal end of said seat supporting arm, and second bracket means secured to said back of said support assembly for receiving said proximal end of said seat supporting arm, said second bracket means including locking means for adjusting the distance of said seat from said vertical column and said support assembly, whereby said seat can be lowered into the bath tub without contacting said column or said support member.

2. The device of claim 1, said seat having a joint secured thereunder and being provided with extension means pivotably mounted on said joint for holding the bather's legs in a horizontal position and lever means for actuating said extension means, said lever means being lockable in the rest or horizontal position.

3. The device of claim 1, said support member being made of a material which resists corrosion.

4. The device of claim 1, further comprising a plastic casing covering said support member.

5. The device of claim 1, further comprising control handle means and supply pipe means for operating said jack.

* * * * *